US009956464B2

(12) United States Patent
Moritz et al.

(10) Patent No.: US 9,956,464 B2
(45) Date of Patent: May 1, 2018

(54) BALL BAT BARREL WITH LUMINESCENT INTERIOR

(71) Applicant: Wilson Sporting Goods Co., Chicago, IL (US)

(72) Inventors: Richard E. Moritz, Portland, OR (US); Brent R. Slater, Vancouver, WA (US); Sean S. Epling, Portland, OR (US); Mark A. Fritzke, Portland, OR (US); Robert T. Thurman, Plainfield, IL (US); Ty B. Goodwin, Vancouver, WA (US); Joshua S. Stenzler, Portland, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days. days.

(21) Appl. No.: 15/065,656

(22) Filed: Mar. 9, 2016

(65) Prior Publication Data

US 2016/0184681 A1 Jun. 30, 2016

Related U.S. Application Data

(63) Continuation-in-part of application No. 14/447,588, filed on Jul. 30, 2014, now Pat. No. 9,308,424, which
(Continued)

(51) Int. Cl.

| | |
|---|---|
| ***A63B 59/00*** | (2015.01) |
| ***A63B 59/50*** | (2015.01) |
| ***A63B 59/58*** | (2015.01) |
| ***A63B 60/54*** | (2015.01) |
| ***A63B 60/42*** | (2015.01) |
| *A63B 59/51* | (2015.01) |
| *A63B 71/00* | (2006.01) |
| *A63B 60/52* | (2015.01) |

(Continued)

(52) U.S. Cl.

CPC ..... *A63B 59/50* (2015.10); *A63B 59/58* (2015.10); *A63B 60/42* (2015.10); *A63B 60/54* (2015.10); *A63B 59/51* (2015.10); *A63B 60/04* (2015.10); *A63B 60/16* (2015.10); *A63B 60/46* (2015.10); *A63B 60/52* (2015.10); *A63B 71/0045* (2013.01); *A63B 2102/18* (2015.10); *A63B 2102/182* (2015.10); *A63B 2207/00* (2013.01); *A63B 2209/00* (2013.01); *A63B 2210/50* (2013.01); *A63B 2225/09* (2013.01); *A63B 2225/50* (2013.01)

(58) Field of Classification Search

CPC ..... A63B 2102/18; A63B 2102/182; A63B 59/50–59/59; A63B 2059/581; G09F 3/0292

USPC ..... 473/457, 566, 567, 568; 283/92

See application file for complete search history.

(56) References Cited

U.S. PATENT DOCUMENTS

| | | | |
|---|---|---|---|
| 1,026,990 | A | 5/1912 | Matson |
| 1,499,128 | A | 6/1924 | Shroyer, Jr. |

(Continued)

FOREIGN PATENT DOCUMENTS

| | | |
|---|---|---|
| WO | 9535135 | 12/1995 |

*Primary Examiner* — Mark Graham

(74) *Attorney, Agent, or Firm* — Terence P. O'Brien; Todd A. Rathe

(57) ABSTRACT

A ball bat barrel has an interior surface and a luminescent layer on the interior surface. The luminescent layer, upon being charged, emits light that indicates tampering with the interior surface.

14 Claims, 5 Drawing Sheets

Related U.S. Application Data is a continuation-in-part of application No. 14/041,707, filed on Sep. 30, 2013.

(60) Provisional application No. 61/756,089, filed on Jan. 24, 2013, provisional application No. 61/860,532, filed on Jul. 31, 2013.

(51) Int. Cl.

| | |
|---|---|
| *A63B 60/16* | (2015.01) |
| *A63B 102/18* | (2015.01) |
| *A63B 60/04* | (2015.01) |
| *A63B 60/46* | (2015.01) |

(56) References Cited

U.S. PATENT DOCUMENTS

| | | | | |
|---|---|---|---|---|
| 1,665,195 | A | 4/1928 | Cohn | |
| 3,116,926 | A | 1/1964 | Owen et al. | |
| 3,380,305 | A | 4/1968 | Charell | |
| 3,811,596 | A | 5/1974 | Wilson | |
| 3,876,204 | A | 4/1975 | Moore et al. | |
| 3,897,058 | A | 7/1975 | Koch | |
| 3,963,239 | A | 6/1976 | Fuji | |
| 4,090,709 | A | 5/1978 | Fuji | |
| 4,650,320 | A * | 3/1987 | Chapman | G07D 7/12 250/458.1 |
| 4,759,219 | A | 7/1988 | Cobb et al. | |
| 4,834,376 | A | 5/1989 | Steinberg | |
| 4,951,948 | A | 8/1990 | Peng | |
| 5,114,144 | A | 5/1992 | Baum | |
| 5,219,164 | A | 6/1993 | Peng | |
| 5,277,421 | A | 1/1994 | Rewolinski | |
| 5,303,917 | A | 4/1994 | Uke | |
| 5,380,003 | A | 1/1995 | Lanctot | |
| 5,451,047 | A * | 9/1995 | Liu | A63B 59/50 473/457 |
| 5,456,461 | A | 10/1995 | Sullivan | |
| 5,624,114 | A | 4/1997 | Kelsey | |
| 5,674,138 | A | 10/1997 | Nolan | |
| 5,711,726 | A | 1/1998 | Powers | |
| 6,045,465 | A * | 4/2000 | Alfano | A63B 69/0002 473/422 |
| 6,173,610 | B1 | 1/2001 | Pace | |
| 6,280,353 | B1 | 8/2001 | Brundage | |
| 6,402,634 | B2 | 6/2002 | Lee et al. | |
| 6,443,860 | B1 | 9/2002 | Byrne et al. | |
| 6,485,382 | B1 | 11/2002 | Chen | |
| 6,511,392 | B1 | 1/2003 | Chohan | |
| 6,530,852 | B2 | 3/2003 | Rios | |
| 6,547,673 | B2 | 4/2003 | Roark | |
| 6,549,042 | B2 | 5/2003 | LaChance et al. | |
| 6,682,447 | B1 | 1/2004 | Black | |
| 6,692,386 | B2 | 2/2004 | Brundage | |
| 6,869,373 | B1 | 3/2005 | Byrne et al. | |
| 6,875,135 | B2 | 4/2005 | Forsythe et al. | |
| 6,905,429 | B2 | 6/2005 | Forsythe et al. | |
| 6,939,237 | B1 | 9/2005 | Voden | |
| 6,969,330 | B1 | 11/2005 | Meeker | |
| 7,014,580 | B2 | 3/2006 | Forsythe et al. | |
| 7,140,248 | B1 | 11/2006 | Brundage | |
| 7,140,988 | B1 | 11/2006 | Hinman | |
| 7,198,581 | B1 | 4/2007 | Black | |
| 7,232,387 | B1 | 6/2007 | Heald et al. | |
| 7,311,620 | B1 | 12/2007 | Heald et al. | |
| 7,381,141 | B2 | 6/2008 | Van Nguyen | |
| 7,399,242 | B1 | 7/2008 | Smith | |
| 7,704,159 | B1 | 4/2010 | McDonald | |
| 7,798,926 | B1 | 9/2010 | Hsu | |
| 7,909,705 | B2 | 3/2011 | Gill et al. | |
| 7,914,404 | B2 | 3/2011 | Giannetti et al. | |
| 7,993,219 | B2 | 8/2011 | Whitney et al. | |
| 8,052,547 | B2 | 11/2011 | Nusbaum et al. | |
| 8,083,620 | B2 | 12/2011 | Sims et al. | |
| 8,241,156 | B2 | 8/2012 | Sims et al. | |
| 8,282,516 | B2 | 10/2012 | Chauvin et al. | |
| 8,317,640 | B1 | 11/2012 | Cruz et al. | |
| 8,348,862 | B2 | 1/2013 | Chu | |
| 8,366,153 | B2 * | 2/2013 | Martineck, Sr. | B42D 15/00 283/92 |
| 8,425,353 | B2 | 4/2013 | Jones et al. | |
| 8,827,846 | B2 | 9/2014 | Shocklee | |
| 2002/0061796 | A1 | 5/2002 | Rios | |
| 2002/0094888 | A1 | 7/2002 | LaChance et al. | |
| 2004/0043846 | A1 | 3/2004 | Haynes | |
| 2005/0059515 | A1 | 3/2005 | Chang | |
| 2005/0143203 | A1 | 6/2005 | Souders et al. | |
| 2006/0229147 | A1 | 10/2006 | Nusbaum et al. | |
| 2006/0252586 | A1 | 11/2006 | Nguyen | |
| 2007/0173357 | A1 | 7/2007 | Mauer et al. | |
| 2007/0191156 | A1 | 8/2007 | Van Nguyen | |
| 2008/0058132 | A1 | 3/2008 | Nguyen | |
| 2008/0064538 | A1 | 3/2008 | McNamee et al. | |
| 2008/0070725 | A1 | 3/2008 | Davis | |
| 2008/0085792 | A1 | 4/2008 | Sims et al. | |
| 2008/0220914 | A1 | 9/2008 | Shaw et al. | |
| 2008/0305895 | A1 | 12/2008 | Gant | |
| 2009/0221388 | A1 | 9/2009 | Giannetti et al. | |
| 2011/0098141 | A1 | 4/2011 | Burger | |
| 2011/0111892 | A1 | 5/2011 | Thouin et al. | |
| 2011/0269581 | A1 | 11/2011 | Chen | |
| 2011/0319204 | A1 | 12/2011 | Chang | |
| 2012/0088612 | A1 | 4/2012 | Johnson | |
| 2012/0270685 | A1 | 10/2012 | Lindsey et al. | |
| 2013/0040767 | A1 * | 2/2013 | Gill | A63B 43/06 473/465 |
| 2013/0073248 | A1 | 3/2013 | Perkins et al. | |
| 2013/0095941 | A1 | 4/2013 | Bentley et al. | |
| 2013/0196795 | A1 | 8/2013 | Shocklee | |
| 2015/0202510 | A1 | 7/2015 | Appleton et al. | |

* cited by examiner

BALL BAT BARREL WITH LUMINESCENT INTERIOR

RELATED U.S. APPLICATION DATA

The present application is a continuation-in-part of U.S. patent application Ser. No. 14/447,588 titled BAT CUSTOMIZATION SYSTEM, and filed on Jul. 30, 2014, which is a continuation-in-part of U.S. patent application Ser. No. 14/041,707 titled SYSTEM FOR CUSTOMIZING A BALL BAT, and filed on Sep. 30, 2013, which claims priority to U.S. Provisional Patent Application Ser. No. 61/756,089 filed on Jan. 24, 2013. U.S. patent application Ser. No. 14/447,588 also claims priority to U.S. Provisional Patent Application Ser. No. 61/860,532 filed on Jul. 31, 2013, which are hereby incorporated by reference in their entirety.

BACKGROUND OF THE INVENTION

Baseball and softball bats are well known sporting goods. Such baseball and softball bats are regulated in their size, weight and dimensions. Many ball bats have barrels that are hollow. Such ball bats with hollow barrels are susceptible to unauthorized modifications where an interior of the barrel is shaved or otherwise removed to improperly enhance the performance of the ball bat.

DETAILED DESCRIPTION OF EXAMPLE IMPLEMENTATIONS

Figure 1:
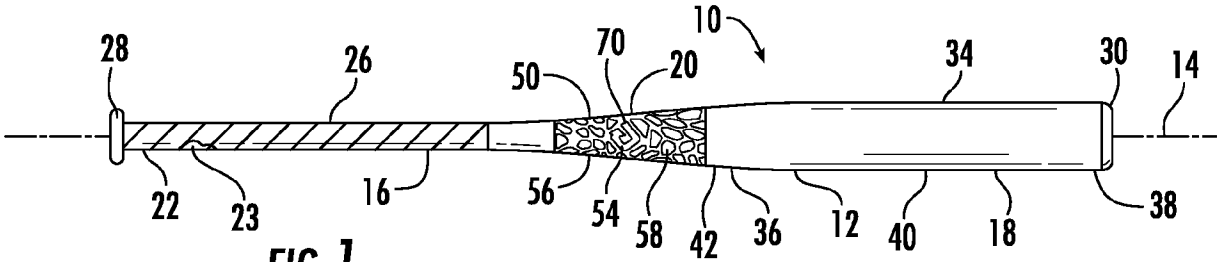
FIG. 1 is a side view of an example ball bat.

Referring to FIG. 1, a ball bat is generally indicated at 10. The ball bat 10 of FIG. 1 is configured as a baseball bat; however, the invention can also be formed as a softball bat, a rubber ball bat, or other form of ball bat. The bat 10 includes a frame 12 and luminescent layer 13. Frame 12 is tubular and extends along a longitudinal axis 14. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches.

The frame 12 has a relatively small diameter handle portion 16, a relatively larger diameter barrel portion 18 (also referred as a hitting or impact portion), and an intermediate tapered element 20. The handle and barrel portions 16 and 18 and the intermediate tapered element 20 are formed as separate structures, which are connected or coupled together. This multi-piece frame construction enables each of the three components to be formed of different materials or similar materials to match a particular player need or application.

Figure 2:
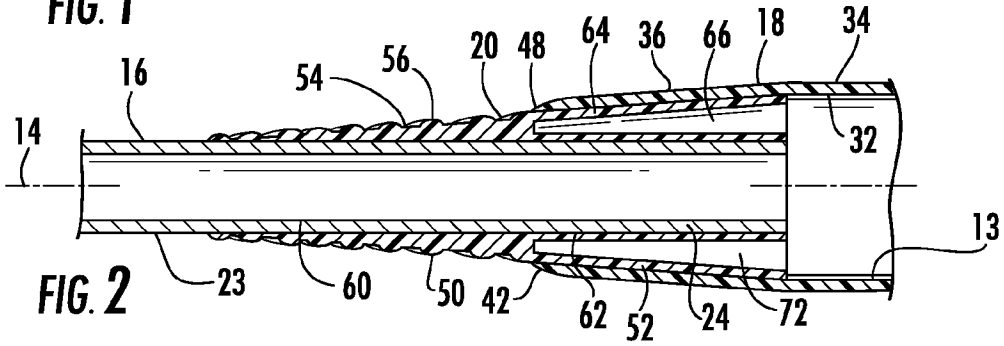
FIG. 2 is a side view of the example bat of FIG. 1 with portions shown in section.

Referring to FIGS. 1 and 2, the handle portion 16 is an elongate tubular structure that extends along the axis 14. The handle portion 16 includes having a proximal end region 22 and a distal end region 24. Preferably, the handle portion 16 is sized for gripping by the user and includes a grip 26, which is wrapped around a core 23 and extends longitudinally along the handle portion 16, and a knob 28 is connected to the proximal end 22 of the handle portion 16. The distal end region 24 is coupled to the element 20. The handle portion 16 is preferably a cylindrical structure having a uniform outer diameter along its length. The handle portion 16 can also have a uniform inner diameter along its length. In alternative implementations, the handle portion can be formed with a distal end that outwardly extends to form a frustoconical shape or tapered shape.

The handle portion 16 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof. In other alternative embodiments, the handle can have slightly tapered or non-cylindrical shapes.

As used herein, the terms "composite material" or "fiber composite material" refer to a plurality of fibers impregnated (or permeated throughout) with a resin. In one example embodiment, the fibers can be systematically aligned through the use of one or more creels, and drawn through a die with a resin to produce a pultrusion, as discussed further below. In an alternative example embodiment, the fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly example implementations, the number layers can range from 3 to 8. In other implementations, the number of layers can be greater than 8. In multiple layer constructions, the fibers can be aligned in different directions (or angles) with respect to the longitudinal axis 14 including 0 degrees, 90 degrees and angular positions between 0 to 90 degrees, and/or in braids or weaves from layer to layer. For composite materials formed in a pultrusion process, the angles can range from 0 to 90 degrees. In some implementations, the layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of example embodiments, the resin is preferably a thermosetting resin such as epoxy or polyester resins. In other sets of example embodiments, the resin can be a thermoplastic resin. The composite material is typically wrapped about a mandrel and/or a comparable structure (or drawn through a die in pultrusion), and cured under heat and/or pressure. While curing, the resin is configured to flow and fully disperse and impregnate the matrix of fibers.

The barrel portion 18 of the frame 12 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. Alternatively, other hollow, tubular shapes can also be used. The barrel portion 18 extends along the axis 14 and has an inner surface 32 and an outer surface 34. The barrel portion 18 includes a proximal region 36, a distal region 38 spaced apart by a central region 40. The barrel portion 18 is configured for impacting a ball (not shown), and preferably is formed of a strong, durable and resilient material, such as, an aluminum alloy. In alternative example embodiments, the proximal member 36 can be formed of one or more composite materials, a titanium alloy, a scandium alloy, steel, other alloys, a thermoplastic material, a thermoset material, wood or combinations thereof.

The bat 10 further includes an end cap 30 attached to the distal region 38 of the barrel portion 18 to substantially enclose the distal region 38. In one example embodiment, the end cap 30 is bonded to the distal region 38 through an epoxy. Alternatively, the end cap can be coupled to the distal region through other adhesives, chemical bonding, thermal bonding, an interference fit, other press-fit connections and combinations thereof.

Figure 3:
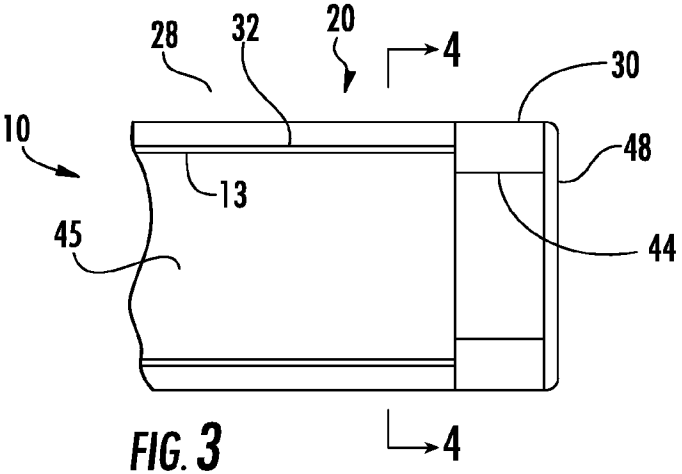
FIG. 3 is a fragmentary sectional view of the bat of FIG. 2 taken along line 3-3.

As shown by FIG. 3, in the example illustrated, end cap 30 comprises an opening 44 through which a person may visibly inspect interior 45 and layer 13 with end cap 30 in place, secured to the end of barrel portion 18. In one implementation, opening 44 is hollow or void, forming a continuous open air filled passage extending from the exterior of bat 10 and is covered by a cover 48, wherein the cover, when secured to the remainder of end cap 22 is transparent in those portions opposite to opening 44. In yet another implementation, opening 44 is filled with a transparent material or is plugged with a transparent material, such as a transparent polymer, glass like material or the like allowing a person to see through the transparent material into the interior 45. In implementations where opening 44 is filled with a transparent material, cover 48 may be omitted.

Referring to FIGS. 1 and 2, an example embodiment of the intermediate tapered element 20 is shown in greater detail. The element 20 is a transitional member that connects the handle portion 16 to the barrel portion 18. In one example embodiment, the element 20 includes a tapered proximal region 50 and a barrel engaging region 52. In particularly example embodiments, the barrel engaging region 52 can also be tapered similar to the proximal region 50 such that the element has a frustoconical shape.

The element 20 can be formed of a single material, or two or more different materials. In one example embodiment, the element 20 includes a base layer 54 formed of a first material and an outer layer 56 formed of a second material. The first and second materials are preferably formed of lightweight, tough durable materials, such as engineered thermoplastic polyurethane (ETPU). Alternatively, the first and second material can be formed of other materials, such as thermoplastic materials, thermoset materials, a composite material, a fiber composite material, aluminum, an alloy, wood, and combinations thereof. The first material preferably has a durometer value (hardness value) within the range of 45 on the Shore D hardness scale to 150 on the Shore R hardness scale. In a particularly example embodiment, the first material has a durometer value within the range of 100 to 140 on the Shore R hardness scale. The first material preferably has a durometer value in or near the Shore R hardness scale. One important aspect of the present invention is that although the first material of the element 20 is formed of a hard material, the element 20 significantly reduces the level of undesirable vibrational and shock energy extending from the barrel portion 18 to the handle portion 16 upon impact with a ball. The second material preferably has a durometer value within the range of 20 on the Shore A scale to 120 on the Shore R scale. In a particularly example embodiment, when the element is formed with a second material, the second material has a durometer within the range of 20 to 90 on the Shore A scale. The first and second materials can be different materials or the same material but with different characteristics, such as hardness. The first material is preferably harder or has a Shore durometer value that is greater than the second material. In an alternative example embodiment, the first and second materials can have the same or similar hardness values. In another alternative embodiment, the second material can have a hardness value that is greater than the first material.

Incorporation of the outer layer 56 provides additional design flexibility to the element. In embodiments where the second material of the outer layer 56 has a lower durometer value than the base layer 54, the outer layer 56 has a different feel when touched. The outer layer 56 may be continuous and entirely cover the base layer 54, or the outer layer 56 can be formed into a variety of different shapes or patterns with portions of the base layer 54 visible through one or more openings 58 defined in the outer layer 56. FIGS. 1 and 2 illustrate the outer layer 56 wherein portions of the base layer 54 are visible through the openings 58 in the outer layer 56. FIGS. 1 and 2 illustrate an example embodiment, and is not intended to be limiting. The present invention contemplates the use of other designs, patterns, shapes, and graphical and/or alphanumeric indicia. In one example embodiment, the outer layer 56 can be configured to form graphical and/or alphanumeric indicia 70 representative of a trademark (such as, for example, the DeMarini® "D" registered trademark), a service mark, a design, a logo, a certification mark, a warning, an instruction, other markings or combinations thereof. The outer layer 56 is preferably slightly raised with respect to the base layer 54 such that the graphic, design or pattern taken by the outer layer 56 is more pronounced, three dimensional and visible. Additionally, the base layer 54 can be formed in one color or multiple colors, and the outer layer 56 can be formed in a different color, or a different combination of colors. In other example embodiments, the base layer 54 and the outer layer 56 can use the same color or the same color combinations. The outer layer 56 can also have a different texture than the base layer 54.

The element 20 is preferably an injection molded member produced in an injection mold or operation using an injection molding apparatus. The injection molding apparatus can include an injection mold having a mold cavity that defines the shape of the element 20 (or one half of the element). In one example embodiment, the element 20 is injection molded over the handle portion 16. The handle portion 16 extends within the mold (and essentially forms part of the mold) and the first material of the element 20 is injection molded about the handle portion. The injection molding of the element 20 over the handle portion 16 is referred to as over-molding of the element 20 to the handle portion 16. The mold can be a split mold having two major sections. The thermoplastic material can be injected into the mold cavity from an injection molding extruder. The thermoplastic material can be supplied through an inlet tube to the interior of the extruder, which is heated to reduce the viscosity of the thermoplastic material and make it flowable. A piston or screw can be used to force the flowable thermoplastic material out of the extruder into a manifold system, which can be heated. The manifold system can include one, two, three or more flow paths for routing the flowable thermoplastic material to injection ports. The locations of the injection ports are preferably spaced apart to enable the thermoplastic material to readily flow and fill the mold cavity in an efficient and timely manner. The injection of the flowable thermoplastic material can be performed in stages through the use of one or more valves. One or more sensors, such as pressure and/or temperature sensors, can be utilized with the mold to determine when the flowable thermoplastic material has reached selected locations within the mold cavity. When the flow of the thermoplastic material reaches a predetermined value, such as a predetermined pressure at one of the pressure sensors, the valve can reposition and reroute or redirect the flow of the thermoplastic material down a second flowpath through a second injection port. In alternative example embodiments, other forms of injection mold apparatuses can be used. The type of mold, the number of flow paths, the number of injections ports or gates, the number of valves, the configuration of the valves, the type of extruder or other injection mechanism, the configuration, pressure, temperature and order of the flow and introduction of the thermoplastic material can be varied. The injection molding apparatus described above is one example and is not intended to be limiting. One of skill in the art understands that a wide variety of injection molding apparatuses can be used to achieve the desired result from injection molding process or operation.

In one example embodiment, the distal end region 24 of the handle portion 16 can be inserted into the injection mold such that the element 20 is injection molded around the distal end region 24. The distal end region 24 of the handle portion 16 is preferably unfinished and roughened to enhance the bonding from the molding of the element 20 to the region 24. The over-molding of the element 20 to the distal end region 24 of the handle region 16 produces an exceptional bond between the two components. As the injection molded first material of element 20 cures it shrinks slightly and further increases the bond strength of the element 20 to the handle portion 16. Accordingly, the element 20 is shrink-fit to the handle portion 16. Importantly, in the over-molding process, no separate adhesive or additional fastener is required. Therefore, in an example embodiment, the element 20 is over-molded to the handle portion 16 without the use of a separate adhesive or one or more mechanical fasteners. The bonding and shrinkage of the first material of the element 20 to the handle portion 16 provides and exceptionally strong connection. Empirical testing of the bond of the element 20 to the distal end region 24 found a resistance to separation of the element 20 molded to the handle portion 16, even when placed under a 5000 lbf load.

In an alternative example embodiment, the element can be molded or injection molded apart from the handle portion and attached to the handle portion after it has been formed. In still other example embodiments, the element can be coupled to the handle portion by one or more intermediate layers of material or fasteners.

When the element 20 is formed with a base layer 54 and an outer layer 56, the outer layer 56 is preferably over-molded to the base layer 54. The base layer 54 is initially molded and allowed to cure. The base layer 54 is then placed into a secondary mold where the outer layer 56 is over-molded over the base layer 54. The over-molding operation provides an exceptional bond between the base layer 54 and the outer layer 56. The second material of the outer layer 56 flows and fills the secondary mold about the base layer 54 to form the element 20. The first and second materials may be hydroscopic to some degree. Therefore, it is preferable for the over-molding of the outer layer 56 to the base layer 54 to occur relatively soon after the base layer 54 has cured.

The distal ends of the element 20 and the handle portion 16 may terminate at the same point along the axis 14. Alternatively, the distal end region 24 of the handle portion 16 may extend slightly further than the element 20, such that a small amount of the distal end region 24 extends beyond the distal end of the element 20. In another alternative example embodiment, the element 20 may extend slightly beyond the distal end region 24 of the handle portion 16. In an alternative example embodiment, the element 20 can be injection molded in two pieces, then placed about the distal end region 24 and molded to the distal end region 24 under heat and pressure in a separate mold.

In alternative embodiments, the element 20 may be connected to the handle portion 16 through chemical bonding, thermal bonding, one or more fasteners, an adhesive layer, an intermediate bonding layer, or combinations thereof.

As shown by FIG. 2, the element 20 defines a longitudinally extending through bore 60 for receiving the handle portion 16. The barrel engaging region 52 of the element 20 can include a tubular wall 62 that also defines the bore 60, and an outer wall 64 that is spaced apart from the tubular wall 62 by at least one rib 66. The rib 66 can extend radially with respect to the axis 14 from the tubular wall 62 to the outer wall 64. In an example embodiment, the tubular wall 62 and the outer wall 64 define one or more cavities 72 between the ribs 66, or between the tubular wall 62 and the outer wall 64. The cavities 72 preferably extend at least 40 percent of the length of the element 20. In alternative example embodiments, the cavities can extend over less than 40 percent of the length of the element 20 or more than 40 percent of the length of the element 20. In one implementation, the element 20 has eight ribs 66. In alternative example embodiments, the number of ribs 66 can be one, two, three, four, five or more. Preferably, the ribs 66 are evenly spaced or angled apart about the element 20. The ribs 66 provide structural integrity to the element 20 while allowing less material to be used, reduced weight and lower material cost to produce the element 20.

Referring to FIGS. 1 and 2, the frustoconical shape of the barrel engaging region 52 of the element 20 diverges outwardly from the axis 14. The frusto-conical shaped barrel engaging region 52 preferably telescopically engages the proximal end region 36 of the barrel portion 18. The proximal region 36 of the barrel portion 18 generally converges toward the axis 14 to form a frusto-conical shape that is complementary to the shape of the barrel engaging region 52 thereby providing a telescopic interlocking mechanical engagement. The engagement can include an adhesive.

The element 20 is preferably formed as a one piece integral structure that connects the handle portion 16 to the barrel portion 18. The element 20 preferably completely isolates the barrel portion 18 from the handle portion 16 such that no direct contact exists between the handle portion 16 and the barrel portion 18. The one-piece, integral structure means that once formed the element cannot be disassembled into two or more pieces. The one-piece, integral structural cannot be separated into two or more pieces without essentially destroying the element 20. By way of example, the knob 28 and end cap 30 of a ball bat are typically not integral to the bat frame. The knob 28 and/or the end cap 30 can often be removed without destroying either component. If two portions, parts or components of a bat can be separated by removing one or more fasteners, and/or by removing, dissolving or otherwise separating a separate adhesive, the portions, parts or components do not form a one-piece, integral structure. The element 20 reduces unwanted shock and/or vibrational energy generated from impact of the barrel portion 18 with a pitched ball from as it extends up and along the frame 12 to the user's hands. The transition from the dissimilar materials of the barrel portion 18, the element 20 and the handle portion 16 further contributes to dampen or lessen the severity of the shock and/or vibrational energy felt by the batter holding the handle portion 16 during or immediately following impact with the ball. The engagement of the handle to the element and the element to the barrel portion is preferably a non-threaded engagement. Significantly, the element 20 can be configured to essentially decouple vibration and/or shock dampening from stiffness. Generally speaking, if one wished to reduce the shock and/or vibration felt by a batter upon hitting a ball, a soft, flexible, and/or elastomeric material would often be used to provide such dampening. The soft, flexible and/or elastomeric material would also have the effect of reducing the overall stiffness of the bat. Accordingly, reducing the shock and/or vibration felt by a batter when hitting a bat is typically associated with a reduction in the stiffness of the bat. Importantly, the element 20 provides an additional level of design flexibility in that the element can be formed with a high level of stiffness (or resistance to bending) and a high durometer (or a very hard material) but also provides exceptional vibration and/or shock reduction. The decoupling of these stiffness to shock and/or vibration dampening (or damping), and/or the decoupling of hardness to shock and/or vibration dampening are unique attributes provided by incorporation of the element 20 into the ball bat 10 and further increase the design flexibility of a bat designer. The element 20 can be used to significantly reduce the vibration and/or shock energy felt by a batter when impacting a ball (especially off-center impacts) without reducing the stiffness of the ball bat or without reducing the hardness of the element. In other embodiments, the element can be configured to be softer and/or more flexible. The described bat and system provides a player or bat designer with the ability to tailor, tune or customize a bat to meet any need, application or player type.

The bat frame 12 formed of the handle portion 16, the barrel portion 18 and the element 20 has a total length. The handle portion 16 has a length that less than 70 percent of the total length of the bat frame 12. In other example embodiments, the length of the handle portion is less than 60 percent of the total length of the bat frame 12.

Figure 4:
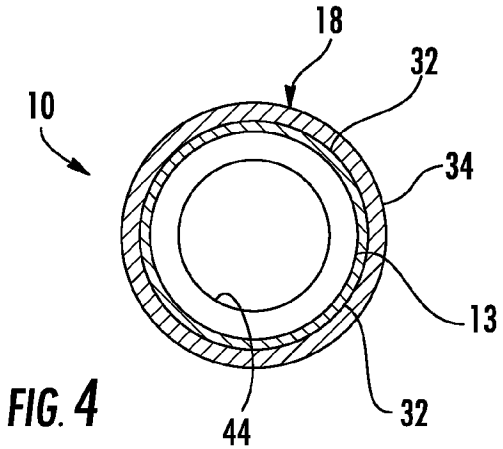
FIG. 4 is a sectional view of the bat of FIG. 3 taken along line 4-4.

As best shown by FIGS. 3 and 4, luminescent layer 13 comprises a layer of material covering inner surface 32 of barrel portion 18 along interior 45. Luminescent layer 13 is formed from a glow-in-the-dark material that itself emits, outputs or discharges light (not just reflecting light), after being charged by, being illuminated or otherwise receiving electromagnetic radiation in the form of light, such as visible light, which is absorbed by layer 13. Because luminescent layer 13 discharges light, rather than just reflecting light, luminescent layer 13 may be charged in the presence of light, such as exposing layer 13 to light and later inspected in the absence of light or in low levels of light where the identification of gaps or openings in layer 13 may be more discernible.

The luminescent layer 13 can utilize photoluminescence, in which the luminescent layer 13 can be exposed to electromagnetic radiation such as visible light, sunlight, and/or UV light. In another implementation, the luminescent layer 13 can be exposed to a radiation source such as X-Rays or gamma rays. The energy needed to activate photo-luminescent materials can be supplied by common light sources such as daylight, light emitting diodes, ordinary tungsten filament and fluorescent lights. For example, a light available on most smart phones can be used to illuminate and/or energize the layer 13 for inspection of the inner surface of the bat barrel by a player, a coach, an umpire or a parent. Photo-luminescent materials include fluorescent materials that absorb light and then emit light instantaneously at a different wavelength. Phosphorescent materials absorb light of a short wavelength, and then emit light slowly over time at a different, longer wavelength. The substance absorbs photons (electromagnetic radiation) and then re-radiates photons. The material is excited to a higher energy state by the electromagnetic radiation and then returns to a lower energy state accompanied by the emission of a photon (causing light). Phosphoresent materials typically absorb light in the UV, Blue region (300 to 450 nm) of the spectrum and emit light in the yellow green region of the spectrum (500 to 600 nm).

In one implementation, luminescent layer 13 comprises a solid layer continuously extending across an entirety of the inner circumferential surface 32 of barrel portion 18. As a result, layer 13 covers, coats or protects the inner circumferential surface 32 of barrel portion 18. To shave or otherwise remove any portions of material along its interior surface 32 also results in removal of the overlying portions of layer 13. The removal of portions of layer 13 and the underlying portions of barrel portion 18 exposes portions of barrel portion 18 through such openings in layer 13. Those portions of barrel portion 18 exposed through such openings in layer 13 are not luminescent. As a result, any unauthorized doctoring of bat 10 through the removal of material of barrel portion 18 along its interior may be easily identified by dark regions, streaks or spots that occur within the otherwise bright light emitting regions within barrel portion 18 provided by layer 13.

In one implementation, layer 13 comprises a material selected from a group of materials consisting of a zinc sulfide based compound and a strontium aluminate compound. In other implementations, layer 13 may comprise other continuous or solid layers of other luminescent material or materials that continuously coat and cover the interior surface 32 of barrel portion 18 such that, absent any removal of layer 13, the entire interior of barrel portion 18 is one solid continuous light discharging surface. The layer 13 can be formed as a single color, or as a pattern of two or more colors.

Layer 13 may be formed or provided along interior 45 of barrel portion 18 in numerous fashions. In one implementation in which barrel portion 18 is made from a fiber composite material, layer 13 may be the innermost layer of barrel portion 18 that is incorporated as part of a layup of the composite portion 18. For example, layer 13 may be formed as an innermost layer of a layup wrapped about a mandrel, wherein the entire layup is molded and cured to produce barrel portion 18.

In another implementation, layer 13 may be formed through the application of a layer of the luminescent material to an inner surface 32 of an aluminum barrel portion 18 or the inner surface 32 of a molded and cured barrel portion 18. For example, in one implementation, layer 13 may be applied and secured to and against surface 32 as a sheet with an adhesive. In one implementation, layer 13 may be provided as a sheet of material having a thickness of between 0.001 and 0.010 in. In such an implementation, adhesives such as but not limited to epoxy, polyurethane, acrylic, or silicone may be used to secure the sheet against the inner surface 32 of barrel portion 18.

In yet another implementation, layer 13 may be formed by a coating that is sprayed or otherwise applied onto surface 32. For example, the coating may be sprayed on and subsequently be allowed to cure to form layer 13. Examples of luminescent material that may be applied as a coating include, but are not limited to zinc sulfide, strontium aluminum oxide, or other luminescent compounds.

FIGS. 5-10 illustrate bat 110, another implementation of bat 10. Those portions of bat which correspond to portions of bat 10 are numbered similarly. Bat 110 is similar to bat 10 except that that bat 110 comprises removable end cap system 120. Removable end cap system 120 covers an end of barrel portion 18 of bat 110. End cap system 120 comprises cup 122 and cover 124 (shown in FIG. 5). Cup 122 mounts within an end of barrel portion 20 and facilitates removable connection of cover 124 across the end of barrel portion 20. In one implementation, cup 122 is fixedly secured within the end of barrel portion 20 by glue, epoxy, welding or other fastening mechanisms. The cup 122 is configured to be fixedly secured to the distal end of the barrel portion 20 so as not to be removed for adjustment of the bat. The cup 122 also serves to prevent debris or unauthorized access to the inner surfaces of the barrel (i.e., to inhibit bat doctoring).

Cup 122 comprises sidewalls 126 and floor 128 which form a cavity 130. Cup 124 further comprises a connector portion 134 within cavity 130. Connector portion 134 cooperates with a corresponding connector portion lid or cover 124 to releasably secure cover 124 to cup 122 over cavity 130. In one implementation, cavity 130 receives electronics, such as a one or more sensors, a processing unit and/or wireless transmitter. In another implementation, cavity 130 receives removable weights of different densities and/or sizes, allowing a person to customize the overall weight at the end of barrel portion 20 and at the end of bat 1210. In one implementation, such weights extend from and are carried by cover 124.

In the example illustrated, at least portions of floor 128 are formed so as to facilitate viewing of an internal bore within barrel portion 20 through floor 128. In the example illustrated, floor 128 is formed from one or more translucent or transparent materials. In yet another implementation, floor 128 comprises one or more windows or openings to facilitate such viewing. Such viewing facilitates inspection of the interior 33 of barrel portion 20. In yet other implementations, floor 128 is opaque, such as where cup 122 is releasable or removal with respect to the end of barrel portion 20 to allow inspection of interior 33 and layer 30. At least a portion of the floor 128 can be transparent, translucent, semi-transparent or semi-translucent to allow for viewing through the floor to for example the internal surfaces of the barrel portion 20. In another implementation, the entire cup 122 can be formed of one or more materials that are transparent, translucent, semi-transparent or semi-translucent.

In the example illustrated, connection portion 134 comprises a bayonet-type connection portion having bayonet female slots 136, formed by ribs or ridges 137, within cavity 130 along sidewalls 126, wherein cover 124 comprises corresponding male pins, tabs or other projections. In yet other implementations, connection portion 134 comprises bayonet male pins, tabs or other projections while cover 124 comprises female slots. In the example illustrated, connection portion 134 comprises a pair of such female slots 136 located on opposite sides of cavity 130, 200 degrees apart from one another. In other implementations, connection portion 134 comprises greater than two female slots 136. For example, in one implementation, connection portion 134 comprises three such slots 136 spaced 118 degrees apart from one another about the cavity 130. In one implementation, the bayonet-type connectors can be spaced apart by for example approximately 200 degrees, but formed for slightly different sizes such that the cover has only one orientation in which it can be properly engaged with the cup.

In the example illustrated, such slots 136 are located proximate to floor 128 such that cover 124 is itself received within cavity 130, wherein electronics and/or weights are carried within cover 124 within cavity 130. In yet other implementations, female slots 136 can be alternatively located near mouth 148 of cavity 130. In still other implementations, connector portion 134 may comprise other structures for releasably securing cover 124 to and over cavity 130. For example, connector portion 134 can alternatively comprise threads, hooks, snaps, other forms of fasteners and the like.

Figure 8:
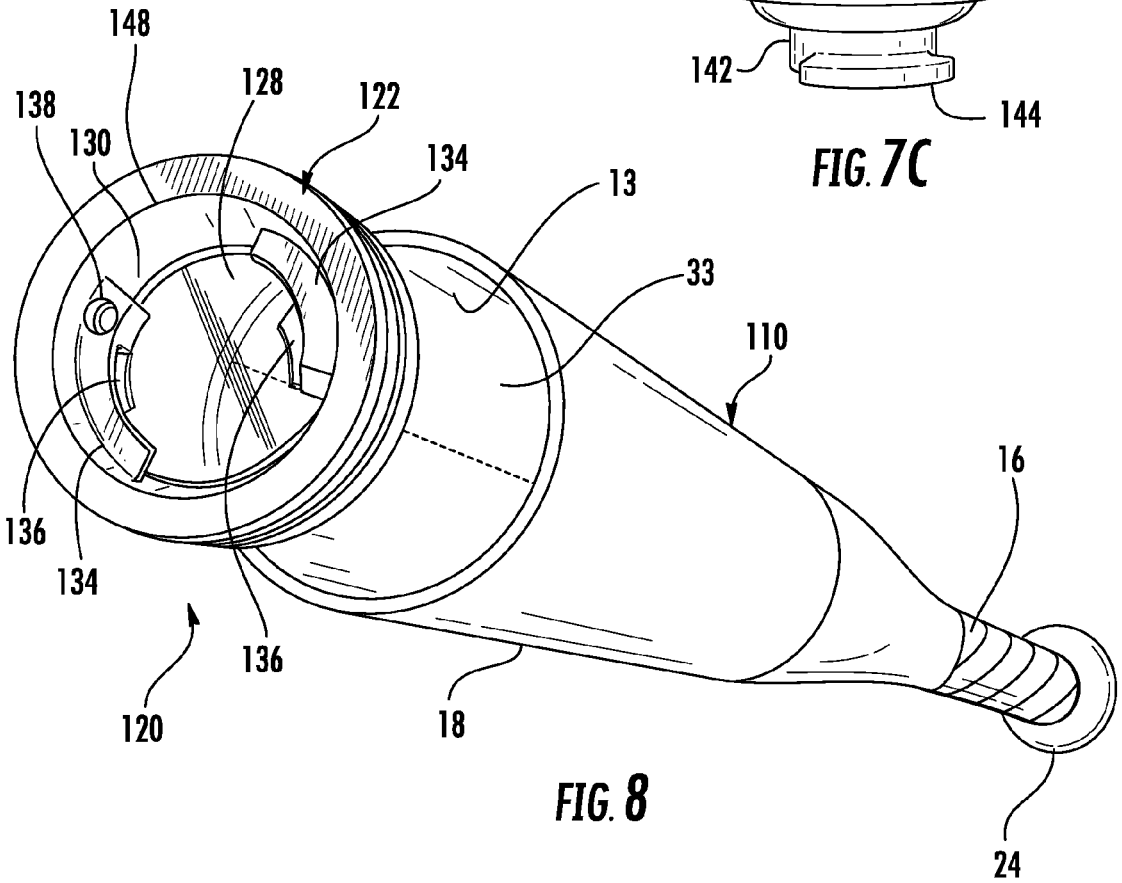
FIG. 8 is an exploded perspective view of the ball bat of FIG. 6 with the example cup separated from the example barrel of the ball bat.
Figure 9:
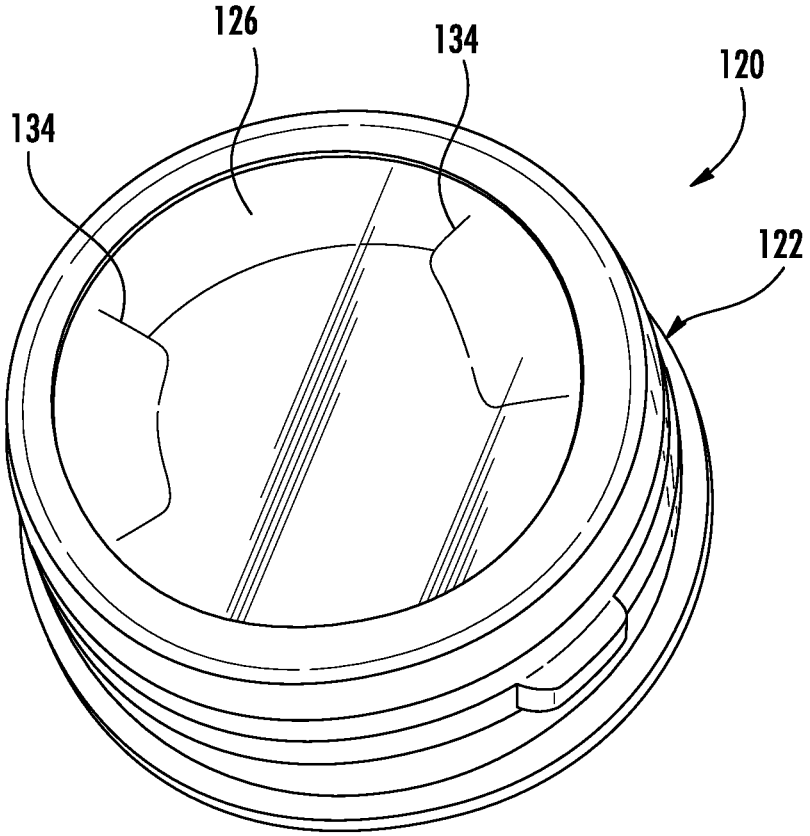
FIG. 9 is a bottom perspective view of the example cup of the ball bat of FIG. 8.
Figure 10:
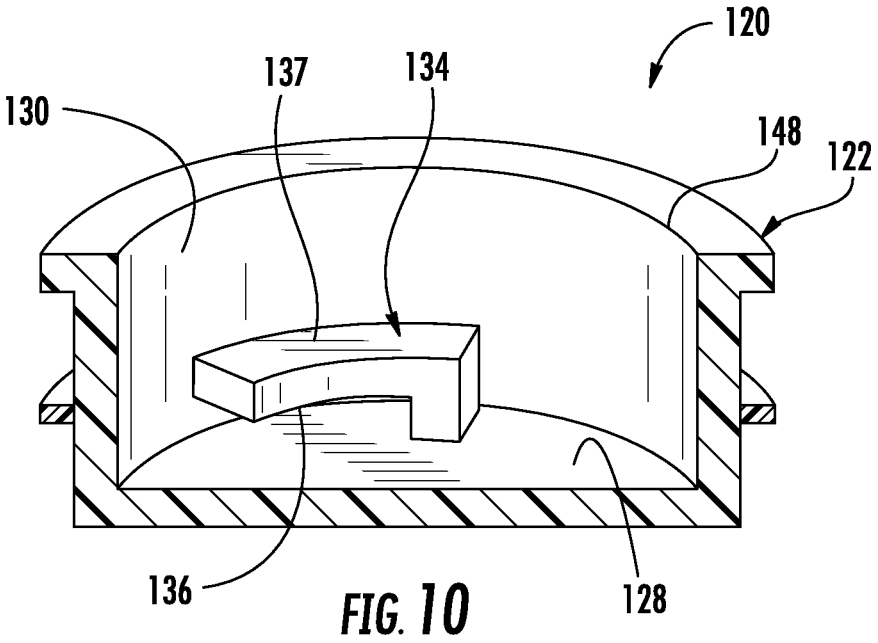
FIG. 10 is a sectional view of the example cup of FIG. 9.

As shown by FIG. 8, in the example illustrated, cup 122 may additionally comprise a threaded bore 138 for receiving a threaded fastener extending from or extending through cover 124. The threaded fastener and threaded bore 138 serve as a secondary locking mechanism to maintain cover 124 in place should the bayonet connection fail or become inadvertently disconnected. In other implementations, threaded bore 138 is omitted. In such implementations, the system 122 advantageously provides a primary locking mechanism (such as the bayonet style connectors or other form of fastener), and a secondary locking mechanism (such as the threaded bore and fastener). In other implementations, other forms or combinations of primary and secondary locking mechanisms can be used. The secondary locking mechanism provides another level of protection, durability and reliability by serving to prevent the separation of the cover from the cup during normal use.

Figure 5:
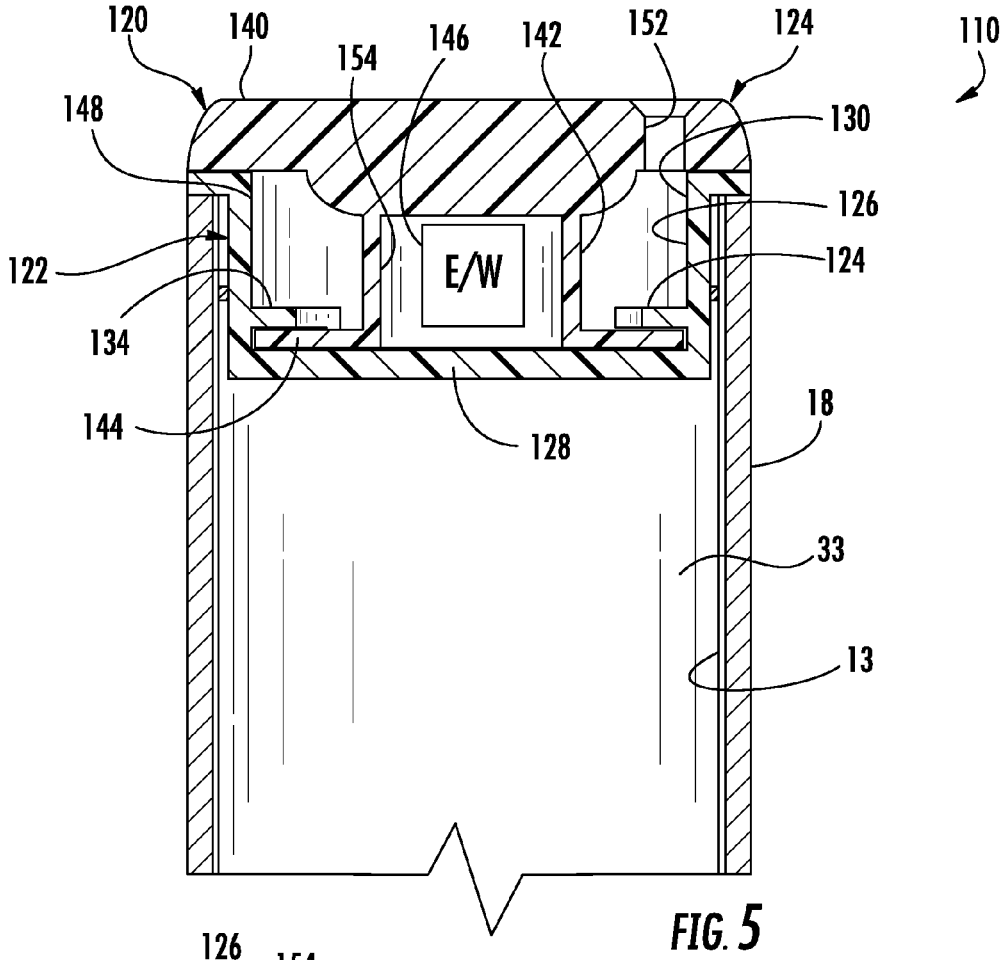
FIG. 5 is a sectional view of an end portion of another example ball bat.
Figure 6:
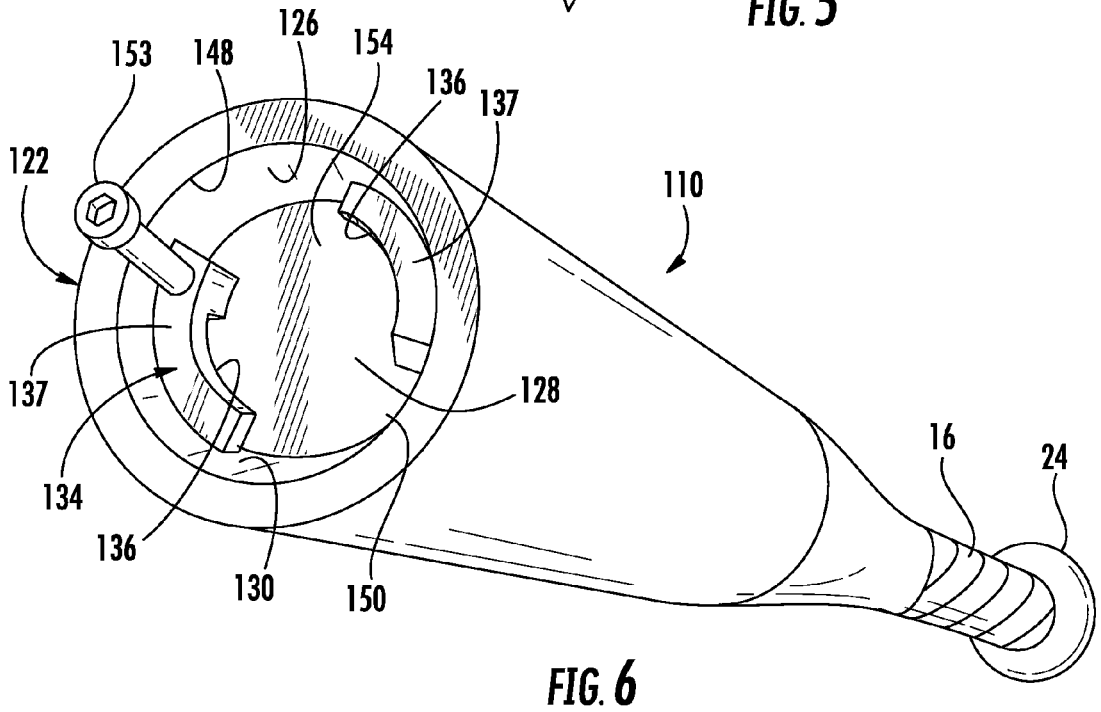
FIG. 6 is a perspective view of the ball bat of FIG. 5 with a cover removed.
Figure 7A:
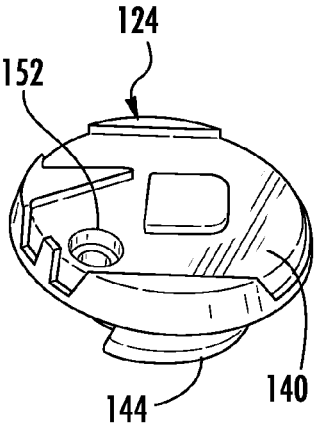
FIG. 7A is a top perspective view of the cover of the ball bat of FIG. 6.
Figure 7B:
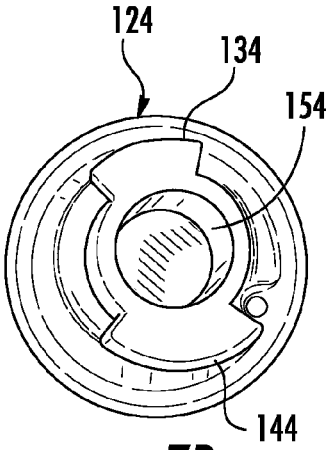
FIG. 7B is a bottom perspective view of the cover of the ball bat of FIG. 6.
Figure 7C:
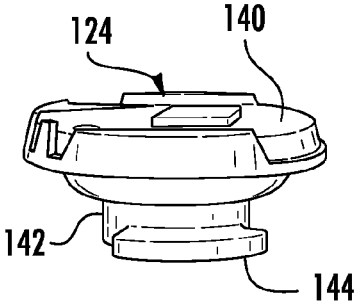
FIG. 7C is a side view of the cover of the ball bat of FIG. 6.

FIG. 5 illustrates cover 124 secured within cup 122 at the end of barrel portion 20 of bat 1210. As shown by FIG. 5, cover 124 comprises lid portion 140, post 142, male bayonet tabs 144 and electronics/weight 146 (schematically shown). Lid portion 140 spans across mouth 148 of cup 122. Post 142 extends down from lid portion 140 and supports male bayonet tabs 144.

Bayonet tabs 144 extend from post 142 and are sized and configured so as to fit into gaps 150 between connector portions 134 (shown as bayonet hooks extending along sidewalls 126 and forming female slots 136). Bayonet tabs 144 are configured such that when cover 124 is fully inserted into cup 122, as shown in FIG. 5, cover 124 is rotatable so as to position tabs 144 within slots 136 to axially retain cover 124 in place relative to cup 122 and the end of bat 1210. In the example illustrated, when tabs 144 are fully inserted into slots 136, opening 152 within lid portion 140 is aligned with threaded bore 138 (shown in FIG. 8) for reception of a fastener 153 (shown in FIG. 6), such as a threaded bolt, through opening 152 and into bore 138, wherein the fastener 153 serves as a secondary cover retention mechanism. In one implementation, the fastener 153 is a captive fastener, such as a captive screw, such that if the fastener or screw was not properly secured it would be readily apparent to the user or other person, such as an umpire that the cover 124 is not properly secured with the secondary locking mechanism. In other implementations, opening 152 and bore 138 are omitted or are replaced with other secondary retention mechanisms.

Electronics/weight 146, schematically shown, is suspended or supported by cover 124. In one implementation, electronics/weight 146 is captured are retained within an interior cavity 154 of post 142 by an adhesive, epoxy, potting or other material. In one implementation, electronics/weight 146 comprises a block of electronics comprising one or more sensors, such as accelerometers, magnetometers, force or impact sensors, combinations thereof, and the like. In one implementation, electronics/weight 146 additionally comprises a wireless transmitter, such as an antenna, and/or in a logical connection to a port by which wired connection or communication may be made with bat 110. In yet another implementation, electronics/weight 146 further comprises a processing unit and memory, wherein the processing unit receives signals from the one or more sensors and stores data based upon the signals in the memory for later retrieval via the wired or wireless connection. In yet another implementation, the processing unit communicates the signals or modifies the signals, such as by compression or filtering, prior to communicating the signals, in real-time, to an external recipient via the port or via the wireless transmitter.

In yet other implementations, electronics/weight 146 comprises a mass of material adding a supplemental amount of weight to the end of bat 110. The amount of weight is varied amongst different interchangeable covers 140 by varying the volume of the weight supplementing material and/or by changing the weight supplementing material itself (changing being different materials having different densities, such as changing from lead to tungsten). In yet other implementations, electronics/weight 146 is omitted.

Figure 11:
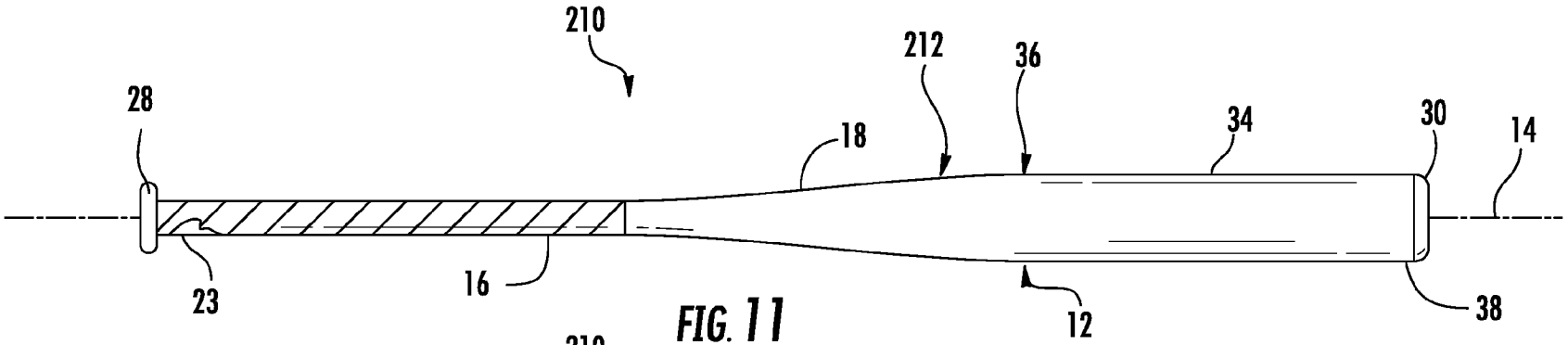
FIG. 11 is a side view of a ball bat in accordance with another implementation of the present invention.
Figure 12:
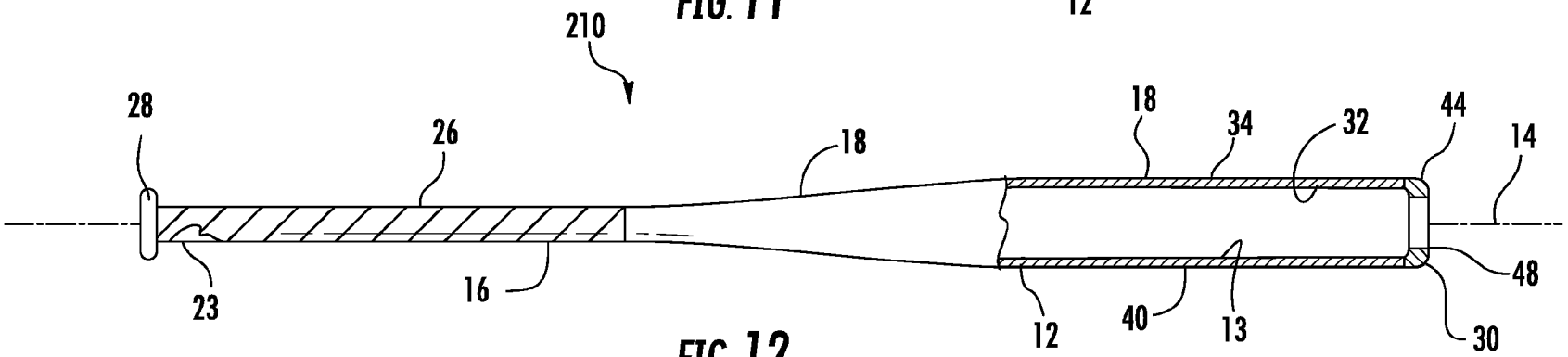
FIG. 12 is a side view of the ball bat of FIG. 11 with a portion of the barrel cut-away.

Although FIGS. 1-10 illustrate luminescent layer 13 utilize in a multi-piece bat construction, in other implementations, luminescent layer 13 may be utilized in other multi-piece bat constructions or with a unitary bat construction to indicate tampering or doctoring with characteristics of barrel portion 18. FIGS. 11 and 12 illustrate bat 210, another example implementation of bat 10 described above. The ball bat 210 of FIG. 11 is configured as a baseball bat; however, the ball bat can also be formed as a softball bat, a rubber ball bat, or other form of ball bat. Bat is similar to bat 10 described above except that bat 210 has a one piece frame 212 in which handle portion 16, barrel portion 18 and tapered portion 20 are all integrally formed as a single unitary body out of a material such as aluminum or a composite material. Similar to bat 10, bat 210 comprises grip 26 wrapped about a core 23 and further includes knob 28 and end caps 30 (described above). Similar to bat 10, bat 210 comprises luminescent layer 13 on the interior surface 32 of barrel portion 18. As described above, the interior of barrel portion 18 may be inspected through opening 44 and end cap 30 to determine whether the interior of barrel portion 18 has been doctored based upon light being emitted by layer 13. Although not illustrated, in other implementations, bat 210 may alternatively comprise removable end cap system 120. While the example embodiments of the invention have been illustrated and described, it will be appreciated that various changes can be made therein without departing from the spirit and scope of the invention. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. An apparatus comprising:

a longitudinally extending ball bat barrel having an interior surface and a distal end;

a luminescent layer on the interior surface, wherein the luminescent layer, upon being charged, emits light that indicates tampering with the interior surface; and an end cap system including a cup fixedly secured to the distal end of the barrel, and a cover removably coupled to the cup, the cup including a planar floor recessed from the distal end and extending over a majority of a transverse cross-sectional area defined by the interior surface, the planar floor formed of a material that is transparent, translucent, semi-transparent or semi-translucent.

2. The apparatus of claim 1, wherein the floor is a window facilitating viewing of the luminescent layer upon the interior surface through the window.

3. The apparatus of claim 1, wherein the interior surface comprises an inner circumferential surface and wherein the luminescent layer comprises a solid layer continuously extending across an entirety of the inner circumferential surface.

4. The apparatus of claim 1, wherein the luminescent layer comprises a material selected from a group of materials consisting of a zinc sulfide based compound and a strontium aluminate compound.

5. The apparatus of claim 1, wherein the interior surface is non-luminescent.

6. The apparatus of claim 1 further comprising a handle coupled to the barrel.

7. The apparatus of claim 1, wherein the barrel comprises an aluminum layer.

8. The apparatus of claim 1, wherein the luminescent layer comprises a sheet of luminescent material adhered to the interior surface of the ball bat barrel.

9. The apparatus of claim 1, wherein the luminescent layer comprises a coating applied to the interior surface of the ball bat barrel.

10. The apparatus of claim 1, wherein the floor extends over at least 75 percent of the transverse area.

11. The apparatus of claim 1, wherein the cover is removably coupled to the cup by at least one fastener.

12. The apparatus of claim 11, wherein the at least one fastener is one or both of a bayonet-type connection and a fastener.

13. A ball bat extending along a longitudinal axis, the bat comprising:

a handle;

a tubular barrel connected to or integral with the handle, the barrel comprising an interior surface, the barrel having a distal end defining a distal plane orthogonal to the longitudinal axis, the inner surface of the tubular barrel at the distal plane defining an interior transverse area;

a luminescent layer on the interior surface, wherein the luminescent layer, upon being charged, emits light that indicates tampering with the interior surface; and an end cap connected to the distal end of the barrel, the end cap comprising a cup inserted into the distal end of the barrel, the cup having a side wall and a floor, the floor including a window facilitating viewing of the luminescent layer upon the interior surface through the window, the window being recessed with respect to the distal plane, the window extending over at least 50 percent of the interior transverse area, the window comprising an unoccluded opening and wherein the ball bat further comprises a cover having a transparent portion opposite the unoccluded opening.

14. A ball bat extending along a longitudinal axis, the bat comprising:

a handle;

a tubular barrel connected to or integral with the handle, the barrel comprising an interior surface, the barrel having a distal end defining a distal plane orthogonal to the longitudinal axis, the inner surface of the tubular barrel at the distal plane defining an interior transverse area;

a luminescent layer on the interior surface, wherein the luminescent layer, upon being charged, emits light that indicates tampering with the interior surface; and an end cap connected to an axial end of the barrel, the end cap comprising a cup inserted into the distal end of the barrel, the cup having a side wall and a floor, the floor including a window facilitating viewing of the luminescent layer upon the interior surface through the window, the window being recessed with respect to the distal plane, the window extending over at least 50 percent of the interior transverse area, the end cap further including a cover extending over the cup and covering the window.

* * * * *